US005942712A

United States Patent [19]

Mello

[11] Patent Number: 5,942,712

[45] Date of Patent: Aug. 24, 1999

[54] METHOD AND APPARATUS FOR RETAINING WIRES IN A CYLINDRICAL TUBE

[75] Inventor: Craig S. Mello, Tiverton, R.I.

[73] Assignee: The United States of America as represented by the Secretary of the Navy, Washington, D.C.

[21] Appl. No.: 08/954,883

[22] Filed: Oct. 9, 1997

[51] Int. Cl.[6] ..... F41F 3/04; B63B 1/00; F42B 19/00

[52] U.S. Cl. ..... 89/1.811; 89/1.809; 89/1.8; 114/238; 114/20.1

[58] Field of Search ..... 89/1.34, 1.8, 1.801, 89/1.806, 1.809, 1.811, 1.51, 1.52, 1.54, 1.55, 1.56, 1.57, 1.59, 1.14; 114/238, 239, 20.1, 20.2, 21.1, 21.2; 220/6, 666

[56] References Cited

U.S. PATENT DOCUMENTS

| | | | |
|---|---|---|---|
| 3,265,023 | 8/1966 | Hollingsworth, Jr. et al. | 114/21.1 |
| 3,613,618 | 10/1971 | Gruber | 114/21.1 |
| 3,703,874 | 11/1972 | Lemieux | 114/21.1 |
| 3,932,922 | 1/1976 | Thastrup | 29/405 |
| 4,635,443 | 1/1987 | Pino | 89/1.14 |
| 4,867,035 | 9/1989 | Boucard et al. | 89/1.55 |
| 5,167,382 | 12/1992 | Rochester et al. | 89/1.34 |
| 5,495,819 | 3/1996 | Marion | 114/238 |

*Primary Examiner*—Charles T. Jordan
*Assistant Examiner*—Theresa M. Wesson
*Attorney, Agent, or Firm*—Michael J. McGowan; Prithvi C. Lall; James M. Kasischke

[57] ABSTRACT

A submarine signal launcher is disclosed for preventing pinched control wires therein. The submarine signal launcher includes a gas generator, an acoustic device countermeasure, a launch tube for housing the gas generator and the countermeasure, and a ram plate positioned between the gas generator and the countermeasure. A status cable is connected to the countermeasure and intermediately threaded through the ram plate and joined to the gas generator. A collapsible tube connected to the ram plate and to the gas generator. The status cable is confined within the collapsible tube. Securing members are formed on opposing ends of the collapsible tube for securing the collapsible tube to the ram plate and the gas generator, wherein upon assembly of the gas generator with the ram plate and the countermeasure within the launch tube, the collapsible tube will protect the cable from being pinched between joined ends of the ram plate and the gas generator.

19 Claims, 2 Drawing Sheets

38,40
16
48
26
46b
38,40
44
48
18
32

46
13
12
16
13
34
44
48
46b
48
46a
28
28
26
18

13
12
13
22
34
16
24
32
44
48
46b
48
46a
28
28
26
14
18

METHOD AND APPARATUS FOR RETAINING WIRES IN A CYLINDRICAL TUBE

STATEMENT OF GOVERNMENT INTEREST

The invention described herein may be manufactured and used by, or for, the government of the United States of America for governmental purposes without the payment of any royalties thereon or therefor.

BACKGROUND OF THE INVENTION (1) Field of the Invention

This invention generally relates to a method and apparatus for retaining wires in a cylindrical tube.

(2) Description of the Prior Art

Existing submarine signal launchers are substantially similar to that shown in FIG. 1 of the present application by way of example only. In particular, there is shown in FIG. 1 a launch tube 16 having housed therein a gas generator 12, an acoustic device countermeasure 14, and a ram plate 26.

More specifically, as shown in FIG. 1, a countermeasure launch tube 16 has a countermeasure 14 loaded therein in front of a ram plate 26. The ram plate 26 has gas seal gaskets 28 formed therearound. The gas generator 12 is positioned behind the ram plate 26 within the launch tube 16. The gas generator 12 has seal gaskets 13 formed therearound. A countermeasure status cable 18 passes from countermeasure 14 through the ram plate 26. The countermeasure status cable 18 has a connector 32 positioned on the distal end thereof. A gas generator status cable 22 having a connector 24 joins with the countermeasure status cable 18 at the connector 32 between the ram plate 26 and the gas generator 12. During a launch, the gas generator 12 explosively generates gas behind the ram plate 26 thereby forcing the ram plate 26 to the end of the launch tube 16, and thus forcefully ejecting the countermeasure 14 from the launch tube 16. At the time of the launch, the connectors 32, 24 detach, and the countermeasure 14 begins its operation.

In use, the countermeasure 14 is fitted into the launch tube 16. The countermeasure 14 has the trailing status cable 18 which is joined to the gas generator status cable 22 prior to loading the gas generator 12 in the launch tube 16. The gas generator 12 is loaded tightly against the countermeasure 14. Often, the status cables 18, 22 or the status cable connectors 32, 24 are pinched between the gas generator 12 and the countermeasure 14. This results in a malfunction of the status cable.

Other known technologies in this area include the following: U.S. Pat. No. 3,932,922 to Thastrup discloses pipe systems for hot media including arranging a number of pipe lengths in continuity to each other with a certain spacing between the adjacent ends thereof, and interconnecting these ends by means of relatively short, axially easily compressible conductor elements such as tube bellows, after which the pipe lengths are axially expanded by sending a hot medium through the pipe system thus assembled, until the single pipe lengths, at a temperature below the expected maximum operational temperature of the system, have expanded sufficiently enough to cause the adjacent pipe length ends to abut against each other, after which these pipe length ends are joined rigidly to their surroundings and subjected to temperature variations without the lack of thermal movability of the pipes causing impermissible stress in the pipes.

U.S. Pat. No. 4,635,443 to Pino discloses a non-fouling actuating mechanism in which an intermediate actuating metal bellows filled with a liquid is positioned between an explosive gas cartridge and an actuating piston in an ordnance ejector system. The liquid in the bellows creates a fluid pressure internal to the bellows equal to the gas pressure external to the bellows. The fluid-filled bellows transmits gas pressure to the piston but prevents damage to the piston and piston seals from the high-pressure, high-temperature erosive gas.

U.S. Pat. No. 5,495,819 to Marion discloses an endothermic gas generator for use in a device propulsion including, in one embodiment, an enclosure having stationary walls and a ram dividing the enclosure into first and second sections and movable in a particular direction to enlarge the first section and reduce the second section. The arrangement fails, however, to teach or suggest the collapsible tube of the present application.

DE Patent No. 4030-712-A to Wenzel et al. discloses a submarine torpedo launching system which protects a torpedo and guidance cable from hot exhaust gases using a sliding piston. The launching system allows the torpedo to be fired from a closed transport container and steered towards the target via a guidance cable. The torpedo and the guidance cable are protected from the hot exhaust gases provided by the firing jet by using a sliding piston within the transport container between the torpedo and the combustion space. The walls of the container are protected by a flame resistant covering deployed by the forward movement of the sliding piston. The flame resistant covering, however, does not protect internal wires from being pinched by adjoining parts as occurs in the present application.

The above devices substantially fail to teach or suggest the method and apparatus disclosed in the present application as directed to the modification of an existing submarine signal launcher to prevent pinched control wires between a gas generator and an acoustic countermeasure.

SUMMARY OF THE INVENTION

Therefore, it is an object of this invention to provide a method and apparatus for modifying an existing submarine signal launcher to prevent pinched control wires between a gas generator and an acoustic device countermeasure which solves the problems found in the above prior art.

In accordance with one aspect of this invention, there is provided a submarine signal launcher for preventing pinched control wires therein. The signal launcher includes a gas generator, an acoustic device countermeasure, a launch tube for housing the gas generator and the countermeasure, and a ram plate positioned between the gas generator and the countermeasure. A countermeasure status cable is connected to the countermeasure and intermediately threaded through the ram plate and a first connector member is connected to a distal end of the countermeasure status cable. A gas generator status cable is connected to the gas generator and a second connector member is connected to a distal end of the gas generator status cable. Each of the first and second connector members are separably connected. A collapsible tube is provided having a first end connected to a breech side of the ram plate and a second end connected to a muzzle side of the gas generator. The first and second connector members, and the countermeasure status cable and the gas generator status cable are confined within the collapsible tube. Opposing ends of the collapsible tube are provided with members for securing the collapsible tube to each of the ram plate and the gas generator, such that upon assembly of the gas generator with the ram plate and the countermeasure within the launch tube, the collapsible tube will protect the cables from being pinched between joined ends of the ram plate and the gas generator.

In accordance with another aspect of this invention, there is provided a method for preventing pinched control wires in a submarine signal launcher, including the steps of providing a gas generator, providing a launch tube for housing the gas generator and the countermeasure, and positioning a ram plate between the gas generator and the countermeasure. A countermeasure status cable is connected to the countermeasure with the countermeasure status cable being intermediately threaded through the ram plate. Further, connecting a first connector member to a distal end of the countermeasure status cable, connecting a gas generator status cable to the gas generator, and connecting a second connector member to a distal end of the gas generator status cable, each of the first and second connector members being separably connected. Still further steps include positioning the collapsible tube such that a first end of a collapsible tube is connected to a breech side of the ram plate and a second end of the collapsible tube is connected to a muzzle side of the gas generator, connecting the first and second connector members of the countermeasure status cable and the gas generator status cable within the collapsible tube, and forming members on opposing ends of the collapsible tube for securing the collapsible tube to each of the ram plate and the gas generator.

Upon assembly of the gas generator with the ram plate and the countermeasure within the launch tube, the collapsible tube protects the cables from being pinched between joined ends of the ram plate and the gas generator.

BRIEF DESCRIPTION OF THE DRAWINGS

The appended claims particularly point out and distinctly claim the subject matter of this invention. The various objects, advantages and novel features of this invention will be more fully apparent from the reading of the following detailed description in conjunction with the accompanying drawings in which like reference numerals refer to like parts, and of which:

DESCRIPTION OF THE PREFERRED EMBODIMENT

Figure 1:
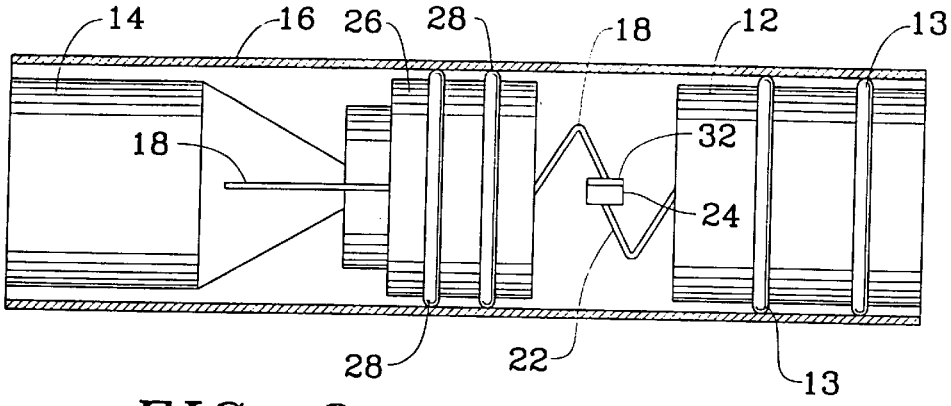
FIG. 1 (PRIOR ART)
FIG. 1 is a cross-sectional side view of a prior art countermeasure launch tube.

The first embodiment of the invention is a modification of the launcher shown in FIG. 1, and the details of the device shown in FIG. 1 will therefore not be repeated herein for purposes of simplicity.

Figure 2:
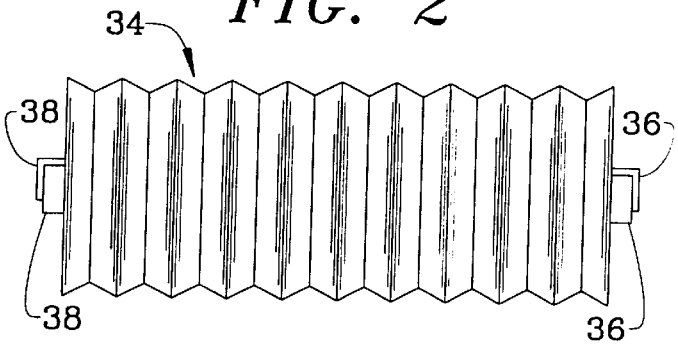
FIG. 2 is a side view of a pleated tube in accordance with the invention.
Figure 3:
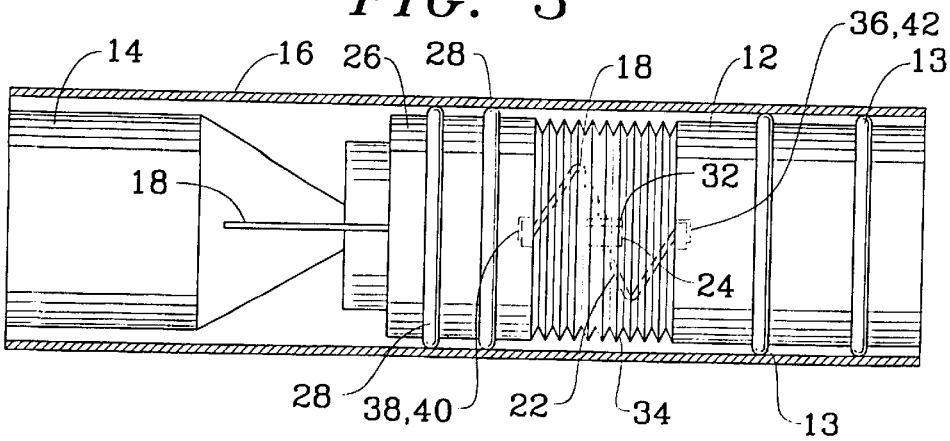
FIG. 3 is a cross-sectional side view of the pleated tube used in a countermeasure launch tube.

FIG. 2 illustrates a pleated tube 34 according to the present invention and FIG. 3 shows the incorporation of the pleated tube 34 within the launcher. Specifically, in FIG. 2 there is shown an accordion pleated tube 34 for positioning in the launch tube 16 between the ram plate 26 and the gas generator 12. The tube 34 is typically a plastic pleated tube such as that used in home dryer exhaust connections.

The pleated tube 34 has at least two attachment members 36, 38 at each end. These two attachment members may be formed as, for example, hook and pile type fasteners, having the trade name of VELCRO. Complementary attachment members 40, 42 are positioned on the breech side of the ram plate 26 and the muzzle side of the gas generator 12, respectively. Cables 18 and 22 and connectors 32 and 24 are positioned inside of the tube 34. After launch, the attachment members 36, 42 and 38, 40 can be detached to allow the launch tube 16 to be reloaded.

As best illustrated in FIG. 3, the only modification to the conventional submarine signal launcher is the insertion of the pleated tube 34 therein and the attachment of the pleated tube to the gas generator 12 and the ram plate 26 by means of the complementary attachment members 36, 38, 40, 42.

Figures 4, 5, 7:
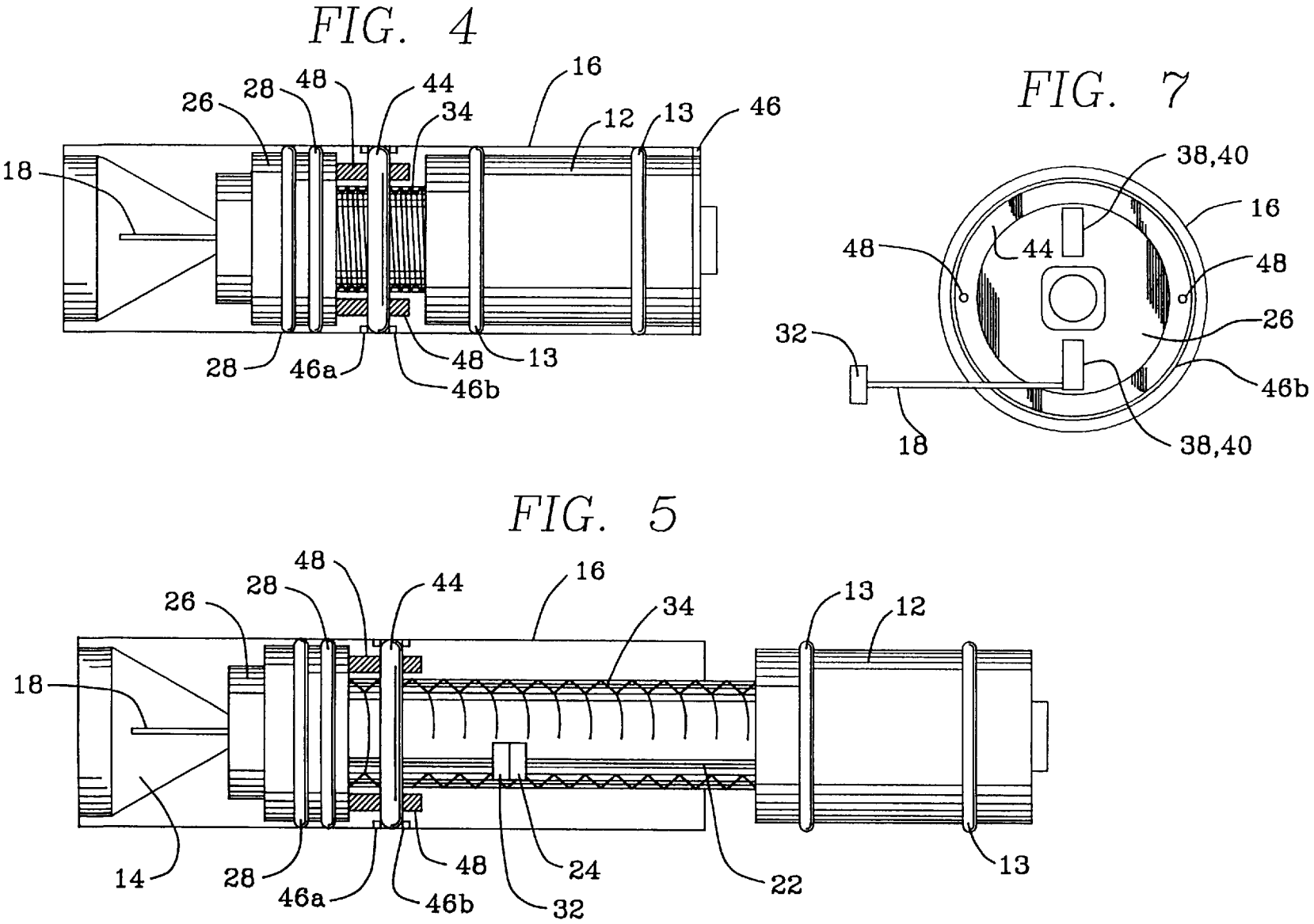
FIG. 4 is an alternative countermeasure launch tube with a pleated tube in a compressed configuration.
FIG. 5 is the alternative countermeasure launch tube as shown in FIG. 4 in an expanded configuration.
FIG. 7 is an end view of a connector end of a ram plate of the invention.

FIG. 4 is an alternative embodiment having a jacking plate 44 joined within launch tube 16. The jacking plate 44 is positioned within the launch tube 16 after loading the countermeasure 14 and the ram plate 26. A forward snap ring 46*a* and an aft snap ring 46*b* are used to hold the jacking plate 44 in place. At least two jacking screws 48 are threaded through the jacking plate 44 and contact the facing surface of the ram plate 26 at a peripheral edge of the ram plate. The jacking plate 44 and the screws 48 are used to tighten the countermeasure device 14 against the forward end of the launch tube 16.

The pleated tube 34 is positioned within the peripheral boundary of the jacking screws 48 such that the attachment members 36, 38, 40, 42, excess cables 18, 22 and connectors 32, 24 are restrained within the collapsible pleated tube 34. The attachment members, excess cables and connectors are therefore free from any pinching during the mating of the gas generator 12 with the ram plate 26 and countermeasure 14.

Figure 6:
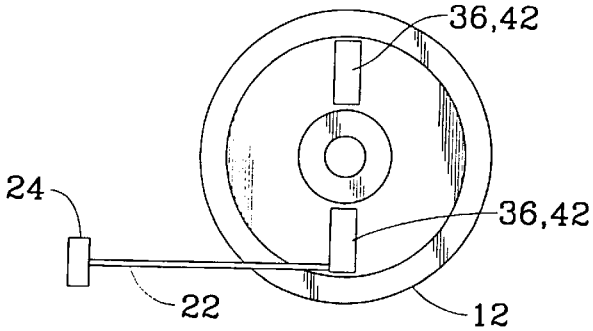
FIG. 6 is an end view of a connector end of a gas generator of the invention.

As shown further in FIG. 5, 6, and 7 the attachment members are folded in and attached to the inside of the ram plate 26, while the attachment members are similarly folded inward and attached to the inside of the gas generator 12.

The method of operation of the launchers shown with the pleated tube 34 therein has been described above in connection with the description of the apparatus of both the first and second embodiments and should be understood by one of ordinary skill in the art.

The method and apparatus described allows connection of status cables between a countermeasure and a gas generator with a lower failure rate by preventing the status cables from being pinched. The invention uses low cost components and can be applied in the field to existing signal launchers without major modifications being made to the signal launcher.

The pleated tube 34 can be of any type of expandable tube. The pleats, however, should be narrow enough to prevent the cable from being pinched therebetween.

This invention has been disclosed in terms of certain embodiments. It will be apparent that many modifications can be made to the disclosed method and apparatus without departing from the invention. Therefore, it is the intent of the appended claims to cover all such variations and modifications as come within the true spirit of this invention.

What is claimed is:

1. A launcher comprising:

a launch tube having a breech end and a muzzle end;

a force generator positioned at said launch tube breech end;

a movable body having a movable body breech end and a movable body muzzle end, said movable body being positioned in said launch tube;

a status cable having a proximate end connected to said movable body and a distal end connected to said force generator;

a longitudinally collapsible tube having a first end connected to said movable body breech end and a second end connected to said force generator, said status cable being confined within said longitudinally collapsible tube; and means for securing said longitudinally collapsible tube to each of said movable body and said force generator, formed on opposing ends of said longitudinally collapsible tube.

2. The apparatus of claim 1 further comprising complementary means for securing positioned on said movable body and said force generator, said complementary means for securing joining with said means for securing.

3. The apparatus of claim 2 wherein said complementary means for securing and said means for securing comprise a hook and pile connector.

4. The apparatus of claim 2 wherein:

said means for securing said longitudinally collapsible tube comprises hook and pile fastener members; and said complementary means for securing comprises complementary hook and pile fastener members.

5. The apparatus of claim 4 wherein said hook and pile fastener members of said longitudinally collapsible tube are folded down over corresponding fasteners formed on said force generator and said hook and pile fastener members of said longitudinally collapsible tube are folded down over corresponding fastener members formed on said movable body.

6. The apparatus of claim 1 further comprising a projectile positioned at said movable body muzzle end, said status cable joining said projectile at said proximate end.

7. The apparatus of clam 6 wherein said status cable comprises:

a projectile status cable joined to said projectile at one end and having a first connector positioned at the projectile status cable other end; and a force generator status cable joined to said force generator at one end and having a second connector positioned at the force generator status cable other end, said first connector being detachably joined to said second connector.

8. The device of claim 6 wherein said launch tube is formed of two ends, including a first end housing said projectile and said movable body, and a second end housing said force generator.

9. The apparatus of claim 1 wherein said force generator is positioned inside said launch tube at the breech end thereof.

10. The apparatus of claim 9 wherein said force generator is a gas generator.

11. The apparatus of claim 1 wherein said force generator includes gas seal gaskets formed therearound.

12. The apparatus of claim 1 wherein said movable body includes gas seal gaskets formed therearound.

13. The apparatus of claim 1 further comprising:

a jacking plate positioned between said movable body and said force generator within said launch tube; and at least a pair of jacking screws fixed to the breech end of said movable body and threaded through said jacking plate, wherein upon assembly of said launching tube said jacking plate adjusts a position of said movable body within said launching tube and said longitudinally collapsible tube will prevent said status cable from being pinched by said force generator and said movable body upon positioning of said force generator within said launching tube, and wherein said means for securing includes at least a pair of hook and pile fastener members.

14. The apparatus of claim 13 wherein said longitudinally collapsible tube includes accordion shaped folds along the length thereof and having pleats of a width to prevent said cables from being pinched between said accordion shaped folds.

15. A launcher comprising:

a launch tube having a breech end and a muzzle end;

a force generator positioned at said launch tube breech end;

a movable body having a movable body breech end and a movable body muzzle end, said movable body being positioned in said launch tube;

a status cable having a proximate end connected to said movable body and a distal end connected to said force generator;

a longitudinally collapsible tube having a first end connected to said movable body breech end and a second end connected to said force generator, said longitudinally collapsible tube includes accordion shaped folds along the length thereof and having pleats of a width to prevent said status cable from being pinched between said accordion shaped folds, said status cable being confined within said longitudinally collapsible tube; and means for securing said longitudinally collapsible tube to each of said movable body and said force generator, formed on opposing ends of said collapsible tube.

16. A method for preventing pinched control wires in a submarine signal launcher, comprising the steps of:

providing a force generator;

providing a launch tube for housing at least said force generator;

positioning a movable body having a muzzle end a breech end in said launch tube forward of said force generator;

providing a status cable joined to said movable body;

connecting a first connector member to a distal end of said status cable;

connecting a force generator status cable to said force generator;

connecting a second connector member to a distal end of said force generator status cable, each of said first and second connector members being separably connected;

connecting a first end of a longitudinally collapsible tube to a breech end of said movable body and a second end of the longitudinally collapsible tube to said force generator, said first and second connector members, and said status cable and said force generator status cable being confined within said longitudinally collapsible tube; and securing opposing ends of said longitudinally collapsible tube to each of said movable body and said force generator, wherein upon assembly of said force generator with said movable body within said launch tube, said longitudinally collapsible tube protects said status and said force generator status cables from being pinched between joined ends of said movable body and said force generator.

17. The method according to claim 16 wherein said step of securing is performed by providing at least a pair of complementary hook and pile fastener members on said longitudinally collapsible tube ends, said movable body and said force generator.

18. The method according to claim 17 further comprising the steps of:

folding down said hook and pile fastener members over complementary fastener members formed on said force generator; and folding down said hook and pile fastener members of said longitudinally collapsible tube over complementary fastener members formed on said movable body.

19. The method according to claim 16 wherein said longitudinally collapsible tube includes accordion shaped folds along the length thereof and having pleats of a width to prevent said cables from being pinched between said accordion shaped folds.

* * * * *